US007548214B2

(12) United States Patent
Chou et al.

(10) Patent No.: US 7,548,214 B2
(45) Date of Patent: Jun. 16, 2009

(54) DUAL-BAND DIPOLE ANTENNA

(75) Inventors: Jui-Hung Chou, Taichung (TW); Saou-Wen Su, Hsinchu (TW)

(73) Assignees: Lite-On Technology Corporation, Taipei (TW); Silitek Electronic (GZ) Co., Ltd., Guangzhou (CN)

( * ) Notice: Subject to any disclaimer, the term of this patent is extended or adjusted under 35 U.S.C. 154(b) by 14 days.

(21) Appl. No.: 11/979,649

(22) Filed: Nov. 7, 2007

(65) Prior Publication Data

US 2009/0115679 A1 May 7, 2009

(51) Int. Cl.
*H01Q 9/28* (2006.01)

(52) U.S. Cl. ..... 343/795; 343/700 MS

(58) Field of Classification Search ..... 343/700 MS, 343/702, 795

See application file for complete search history.

(56) References Cited

U.S. PATENT DOCUMENTS 6,600,450 B1 * 7/2003 Efanov et al. ..... 343/726
6,621,464 B1 9/2003 Fang et al.
6,961,028 B2 * 11/2005 Joy et al. ..... 343/895
7,145,517 B1 * 12/2006 Cheng ..... 343/795
7,151,500 B2 * 12/2006 Su et al. ..... 343/795
7,183,993 B2 * 2/2007 Dai et al. ..... 343/795
7,230,578 B2 6/2007 Ke et al.

* cited by examiner

*Primary Examiner*—Don P Le
(74) *Attorney, Agent, or Firm*—Rosenberg, Klein & Lee

(57) ABSTRACT

A dual-band dipole antenna includes two radiating arms and a short-circuited element. The two radiating arms and the short-circuited element are formed monolithically. Each radiating arm has a feed-in end and a radiating end. Each radiating arm has a slot that divides the radiating arm into a first radiating portion and a second radiating portion. The resonant frequencies of the first radiating portion and the second radiating portion are different to radiate/receive wireless signals in two frequencies respectively. The short-circuited element is connected to the feed-in end of each radiating arm, so as to electrically connect the two radiating arms. The short-circuited element also makes an included angle formed between the two radiating arms, so as to obtain the effect of dipole gains of the radio waves transferred or received by the two radiating arms.

10 Claims, 11 Drawing Sheets

DUAL-BAND DIPOLE ANTENNA

BACKGROUND OF THE INVENTION

1. Field of Invention

The present invention relates to a dual-band antenna, and more particularly to a dual-band dipole antenna.

2. Related Art

Data transmission for many electronic products has been gradually changed and conducted based on the wireless communication protocol. In consideration of different transmission distances, speeds, and environments, different wireless communication protocols applicable to different bandwidths and frequencies have been proposed.

Most of the conventional antennas are tube or bar shaped, and the length is configured in accordance with the operation frequency specified in the wireless communication protocols, so as to make the antenna to resonate in the specified frequency band. Thus, the antenna can receive/radiate a radio wave accordingly.

However, the conventional antenna is installed outside the electronic device, which is not pleasing to the end user from an esthetic view point. Meanwhile, a single antenna usually meets the frequency of a single wireless communication protocol. If the electronic device is required to transfer/receive wireless signals through different wireless communication protocols, for example, the electronic device is designed to optionally use an indoor wireless local area network and an outdoor high-frequency long-distance wireless network to connect to the network, two antenna with different specifications must be disposed. Thus, the appearance of the electronic device is unsatisfactory. Two or more antennas occupy the outer space of the electronic device, which is adverse to the miniaturization of the electronic device. In order to solve the problem that single antenna cannot meet the dual-band requirement, U.S. Pat. No. 7,230,578 discloses a dual-band dipole antenna, which includes two radiating portions. The two radiating portions are grounded and fed by a coaxial cable, and the radiating portion includes different resonant frequencies, such that each radiating arm has two different resonant frequencies to meet dual-band requirement. Meanwhile, the two radiating arms resonate to generate a signal with half wavelength to achieve the signal gain effect. However, the design disclosed in U.S. Pat. No. 7,230,578 is still an external antenna, which is difficult to be concealed in the electronic device.

Directed to the requirements of the conventional antennas, printed antennas or planar antennas are set forth, in which the antennas are concealed in the electronic device. This antenna is formed by disposing a metal sheet or a metal film on a substrate, and forming specific patterns, so as to make the metal sheet or the metal film has a specific resonant frequency. Since these antennas can be concealed in the electronic devices, the number of the antennas may be easily increased to meet the requirement for multiple frequencies. Or, the antennas can be fabricated into dipole antennas to improve the gain effect. U.S. Pat. No. 6,621,464 discloses a dual-band dipole antenna, which uses two metal sheets to form two radiating arms, and each radiating arm has two radiating portions of different resonant frequencies. The two radiating arms are grounded and fed by a coaxial cable, so as to form a dipole antenna. Although U.S. Pat. No. 6,621,464 solves the problem that the antenna occupies space during installation, the two radiating arms must be installed separately, and the relative position between the two radiating arms influences the effect of the coupling gain. Therefore, a lot of time must be spent on adjusting the relative position of the two radiating arms during the installation the two radiating arms, which is quite inconvenient in installation.

SUMMARY OF THE INVENTION

In view of the problem of inconvenient installation of the conventional dual-band dipole antennas, the present invention is provided a dual-band dipole antenna, so as to solve the problems or disadvantages in the dual-band dipole antenna in prior art.

The dual-band dipole antenna of the present invention includes two radiating arms and a short-circuited element. The two radiating arms and the short-circuited element are formed monolithically. Each radiating arm has a feed-in end and a radiating end. Each radiating arm has a slot that divides the radiating end into a first radiating portion and a second radiating portion. The first radiating portion and the second radiating portion have different resonant frequencies, so as to radiate/receive wireless signals of two frequencies respectively. The short-circuited element is connected to the feed-in end of each radiating arm, so as to electrically connect the two radiating arms and make an included angle formed between the two radiating arms, thus attaining the effect of the coupling gain of the radio waves transferred or received by the two radiating arms.

The advantage of the present invention lies in that, the two radiating arms and the short-circuited element are formed monolithically, so that the relative position of the two radiating arms has been fixed by the short-circuited element. Therefore, the two radiating arms and the short-circuited element can be fixed on a substrate or at an intended installation position, thus saving the time spent on adjusting the relative position of the two radiating arms, and maintaining the predetermined effect of the coupling gain.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
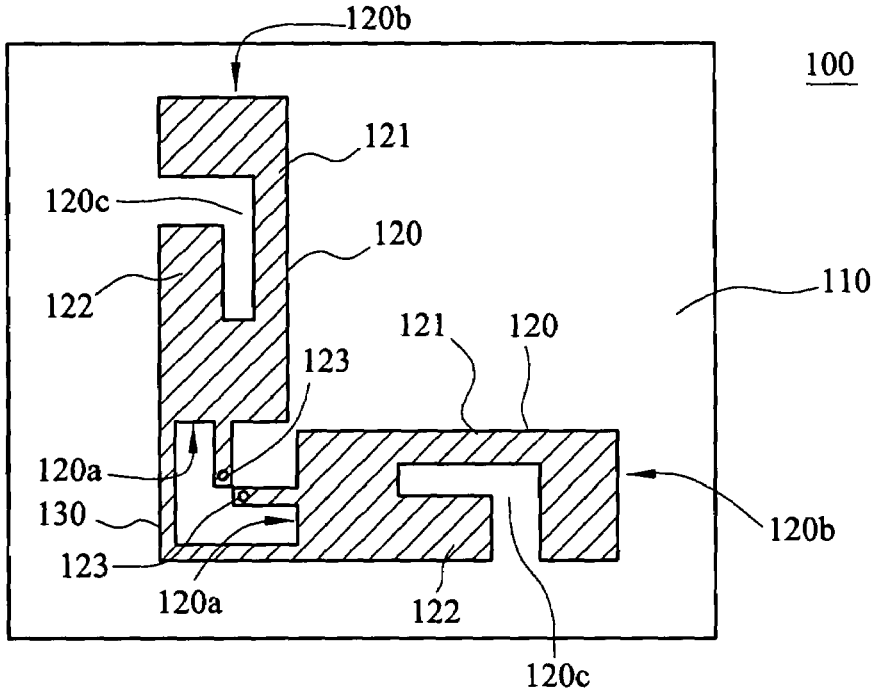
FIG. 1 is a plan view of a first embodiment of the present invention.

Please refer to FIG. 1, a dual-band dipole antenna 100 according to a first embodiment of the present invention is shown. The dual-band dipole antenna 100 includes a substrate 110, two radiating arms 120, and a short-circuited element 130 connecting the two radiating arms 120. The two radiating arms 120 and the short-circuited element 130 are formed monolithically.

Figure 2:
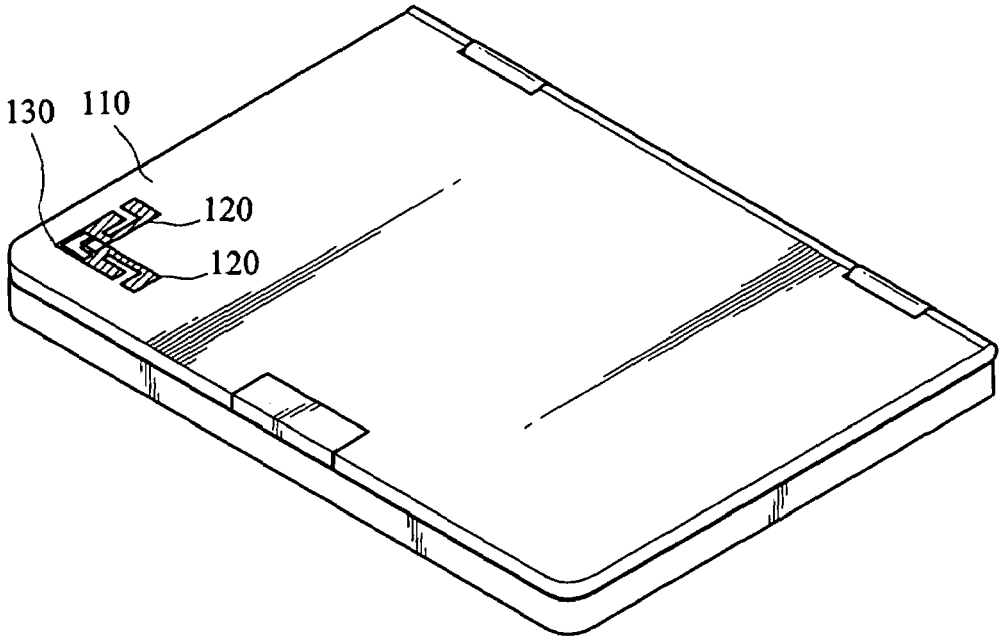
FIG. 2 is a perspective view of the first embodiment.

Referring to FIGS. 1 and 2, the substrate 110 may be a printed circuit board, plastic board, or a board made of an insulating material. The substrate 110 can be a part of a case of an electronic device, as shown in FIG. 2. Or, the substrate 110 also can be disposed in the electronic device. The two radiating arms 120 and the short-circuited element 130 are disposed on the substrate 110. The substrate 110 supports the two radiating arms 120 and the short-circuited element 130 to maintain the configurations of the two radiating arms 120 and the short-circuited element 130. The two radiating arms 120 and the short-circuited element 130 are formed monolithically by means of cutting metallic sheets and being adhered on the substrate 110 with an adhesive. Or, the two radiating arms 120 and the short-circuited element 130 can be formed by means of forming a dielectric layer on the substrate through printing or etching to be configured in a predetermine pattern.

Figure 3:
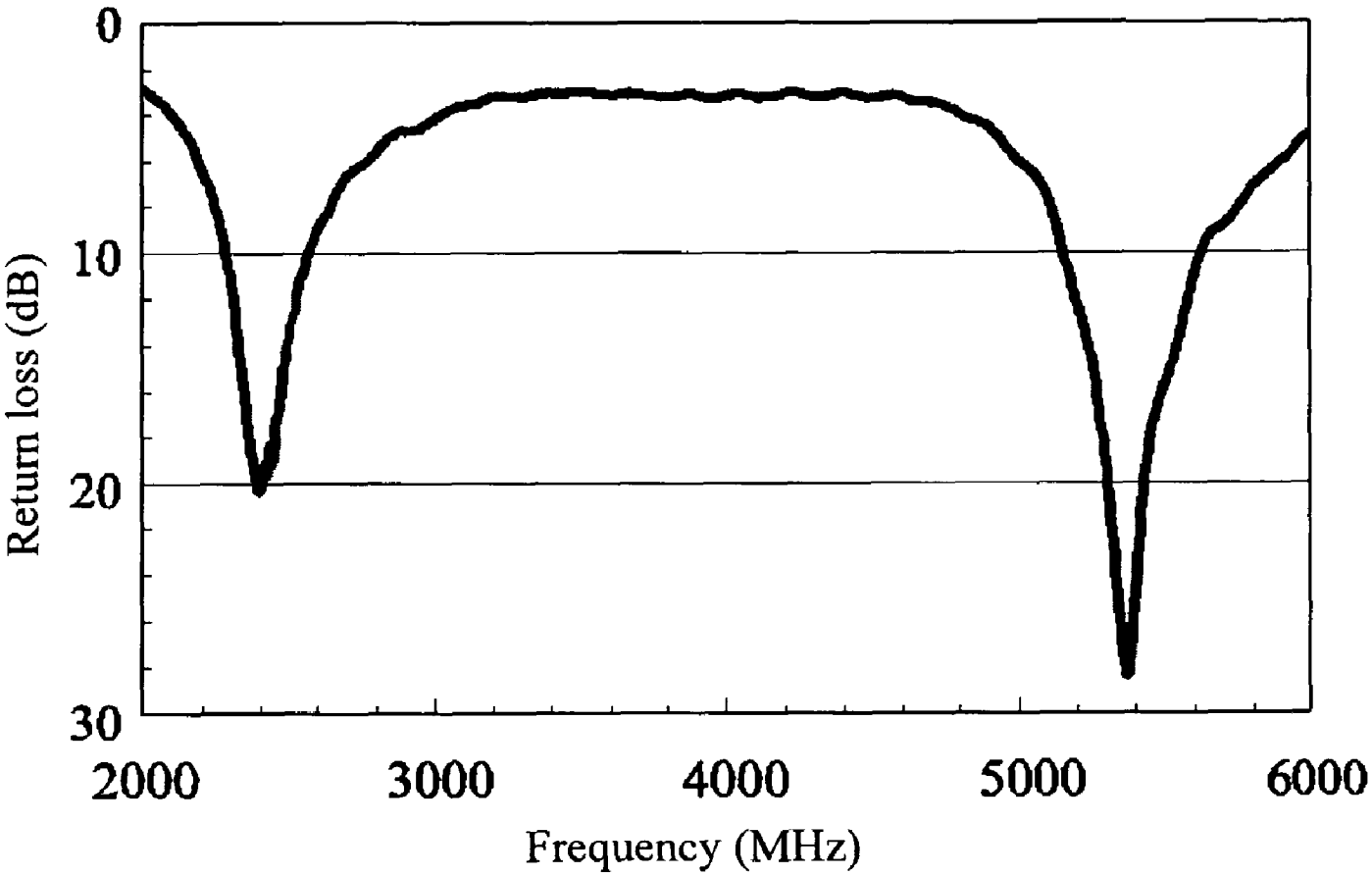
FIG. 3 is diagram showing the relationship between the return loss and the frequency of the first embodiment.

Referring to FIGS. 1 and 3, each radiating arm 120 is long rectangular shaped and has a feed-in end 120*a* and a radiating end 120*b*. Each radiating arm 120 has a slot 120*c* extending from the middle section of the radiating arm 120, or the part near the feed-in end 120*a* towards the radiating end 120*b*, and forming an opening at one edge of the radiating end 120*b*, such that the slot 120*c* divides the radiating end 120*b* into a first radiating portion 121 and a second radiating portion 122. In this embodiment, the slot 120*c* is L-shaped. A closed end of the slot 120*c* is located in a part of the radiating arm 120 near the feed-in end 120*a*, and the other end of the slot 120*c* is at a side edge of the radiating end 120*b*. Thus, the lengths of the first radiating portion 121 and the second radiating portion 122 are different, so as to form different resonant frequencies to generate a signal of half wavelength. Therefore, the radiating arms 120 are adapted to radiate/receive different frequencies, for example, the 2.4 GHz indoor wireless local area network and the 5.2 GHz outdoor high-frequency long-distance wireless network, as shown in FIG. 3. That is, signals generated by the radiating arms 120 have larger return loss at the frequencies of 2.4 GHz and 5.2 GHz. Or, in multiple-input-multiple-output (MIMO) protocol, the radiating arms 120 are responsible for transmitting/receiving signals of two frequencies at the same time. The feed-in end 120*a* has a signal contact 123 for a signal line of a coaxial cable to connect to feed in an electrical signal. An external ground conductor of the coaxial cable can be electrically connected to any portion of the radiating arms 120, thus the first radiating portion 121 and the second radiating portion 122 forms different resonance paths respectively to radiate/receive wireless signals. The direction along the feed-in end 120*a* to the radiating end 120*b* is a direction of resonance frequency.

As shown in FIG. 1, the short-circuited element 130 is mainly used to electrically connect the two radiating arms 120 to provide the mechanical connection function. In the situation of cutting a metallic sheet into the two radiating arms 120 and the short-circuited element 130, the two radiating arms 120 and the short-circuited element 130 can be formed monolithically by cutting a single metallic sheet. At this time, in addition to electrically connecting the two radiating arms 120, the short-circuited element 130 can further provide the mechanical connection function to fix the direction and the included angle between the two radiating arms 120, thereby making the two radiating arms 120 generate the effect of the dipole gain in a specific direction. Meanwhile, as the two radiating arms 120 and the short-circuited element 130 are formed monolithically, in the course of fixing the metallic sheet containing the two radiating arms 120 and the short-circuited element 130 on the substrate 110, the direction and the included angle between the two radiating arms 120 are fixed without readjusting the relative position and the included angle between the radiating arms 120. In this embodiment, the short-circuited element 130 is L-shaped, and has two ends connected to the feed-in ends 120*a* of the two radiating arms 120 respectively. As the short-circuited element 130 is bent 90 degrees at the middle section, the orientations of the two radiating arms 120 are 90 degrees apart. Definitely, the configuration of the short-circuited element 130 is not limited to be L-shaped, and the short-circuited element 130 only needs to connect the two radiating arms 120 to achieve the effect of mechanical connection and electrical connection.

Figure 4:
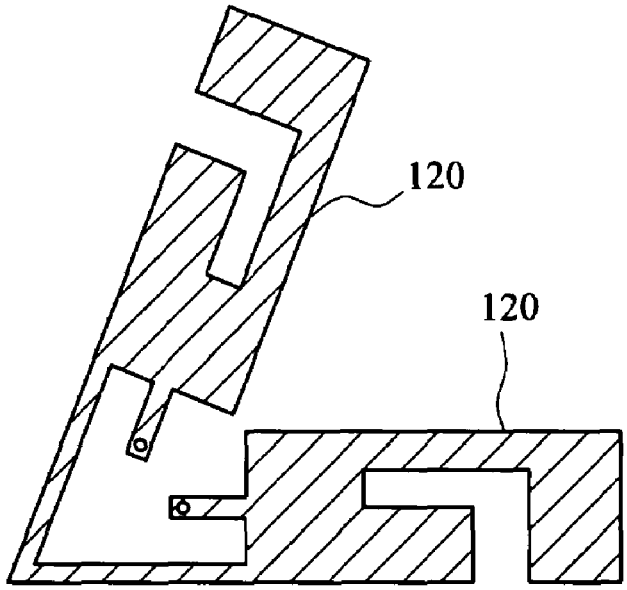
FIGS. 4 and 5 are plan views of the first embodiment.
Figure 5:
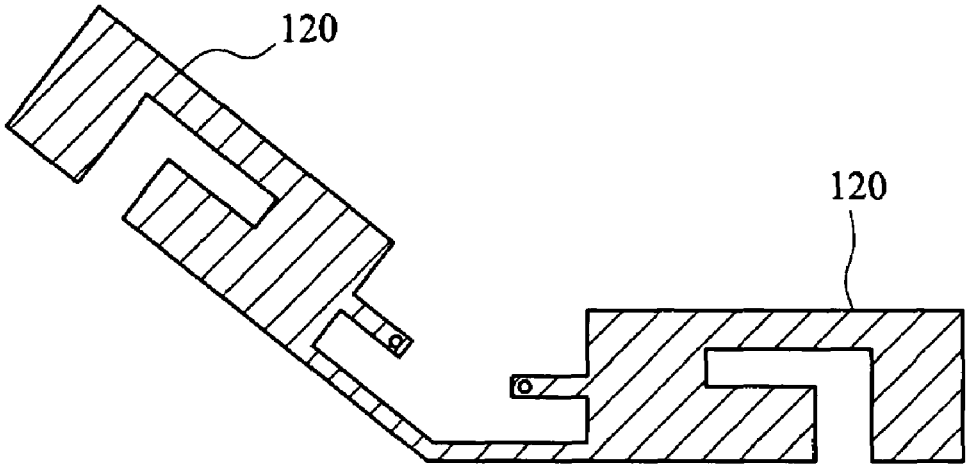
Figure 6:
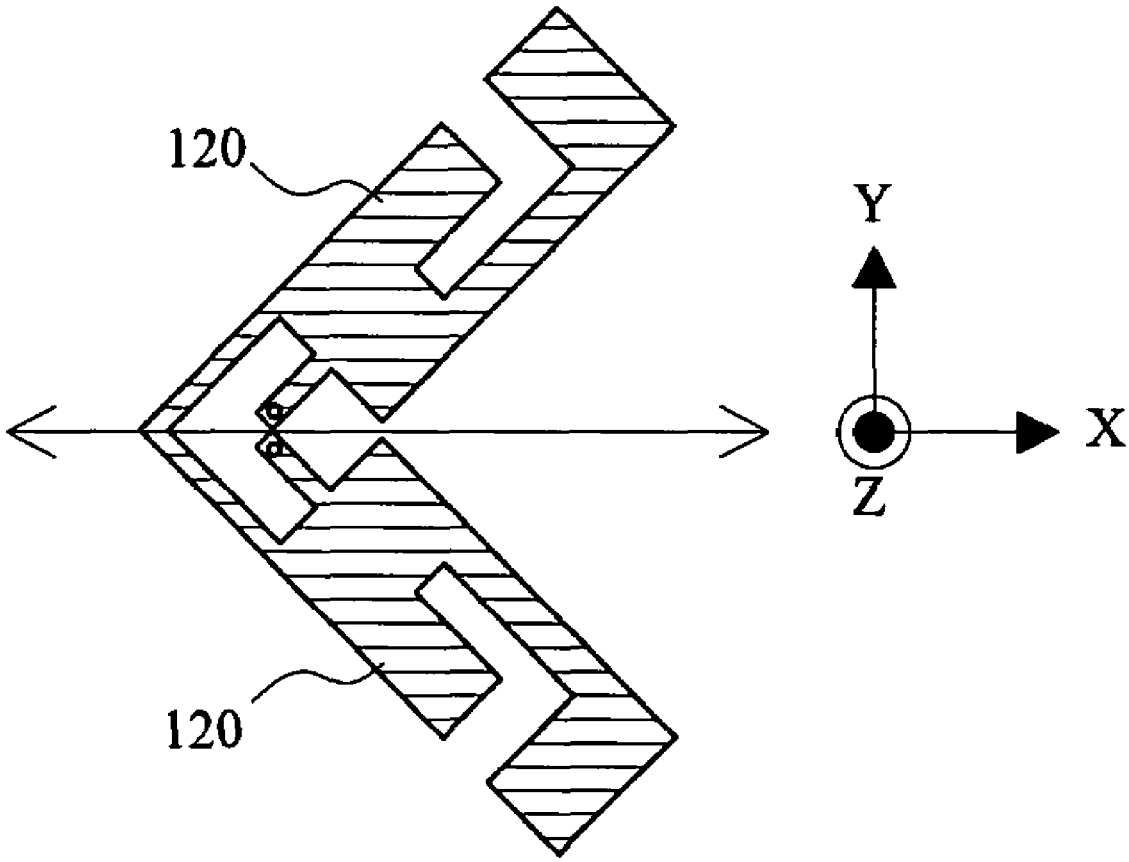
FIG. 6 is a plan view of the first embodiment, in which coordinate axes of the measured field form are marked.

Referring to FIGS. 4 and 5, the included angle formed between two radiating arms 120 is not necessarily 90 degrees. As long as the included angle is less than 180 degrees, the two radiating arms 120 can generate the effect of the coupling gain. The included angle can be an acute angle, as shown in FIG. 4, or an obtuse angle, as shown in FIG. 5.

After the two radiating arms 120 are electrically connected by the short-circuited element 130, the short-circuited element 120 is further electrically connected to a ground line, for example, the external ground conductor of the coaxial cable, so the feed-in ends 120*a* of the two radiating arms 120 form a node together. When an electrical signal is fed in or a radio wave signal is sensed, the two radiating arms 120 will generate two resonant frequencies, and the half wavelength of the two resonant frequencies will be equal to the length of the first radiating portion 121 and the second radiating portion 122. Therefore, the two radiating arms 120 can generate the effect of the dipole gain, thus enhancing the capability of radiating/receiving signals.

Figure 7A:
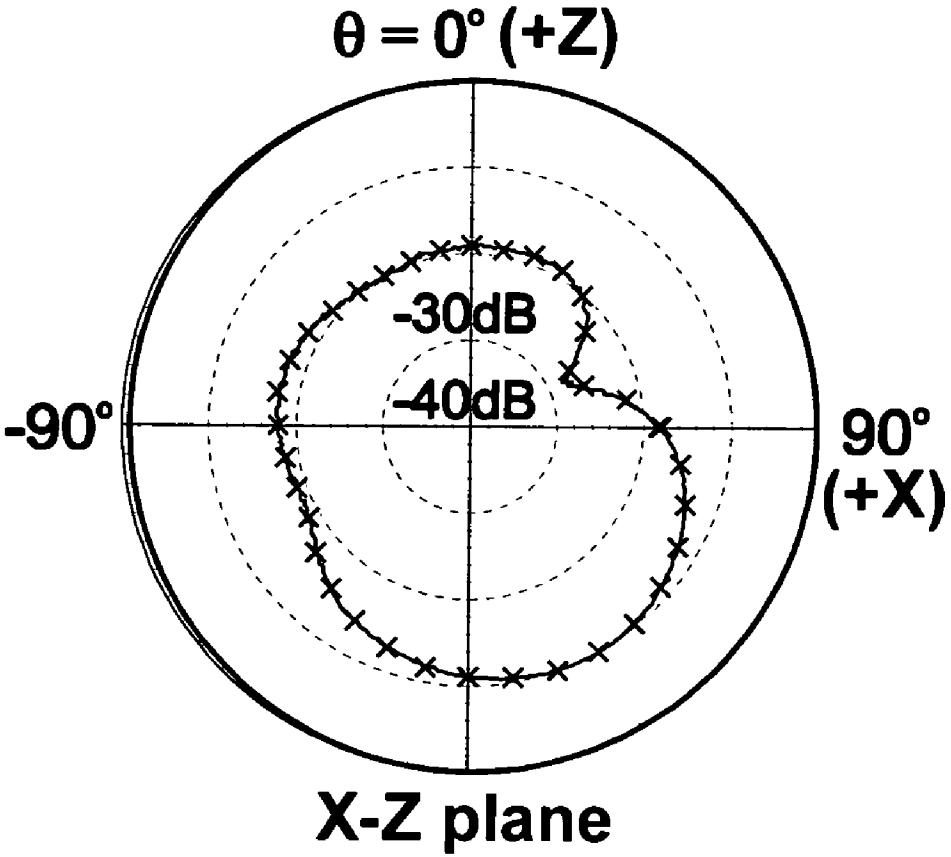
FIGS. 7A, 7B, and 7C show the antenna radiation patterns of the first embodiment at 2.4 GHz at different conference planes.
Figure 7B:
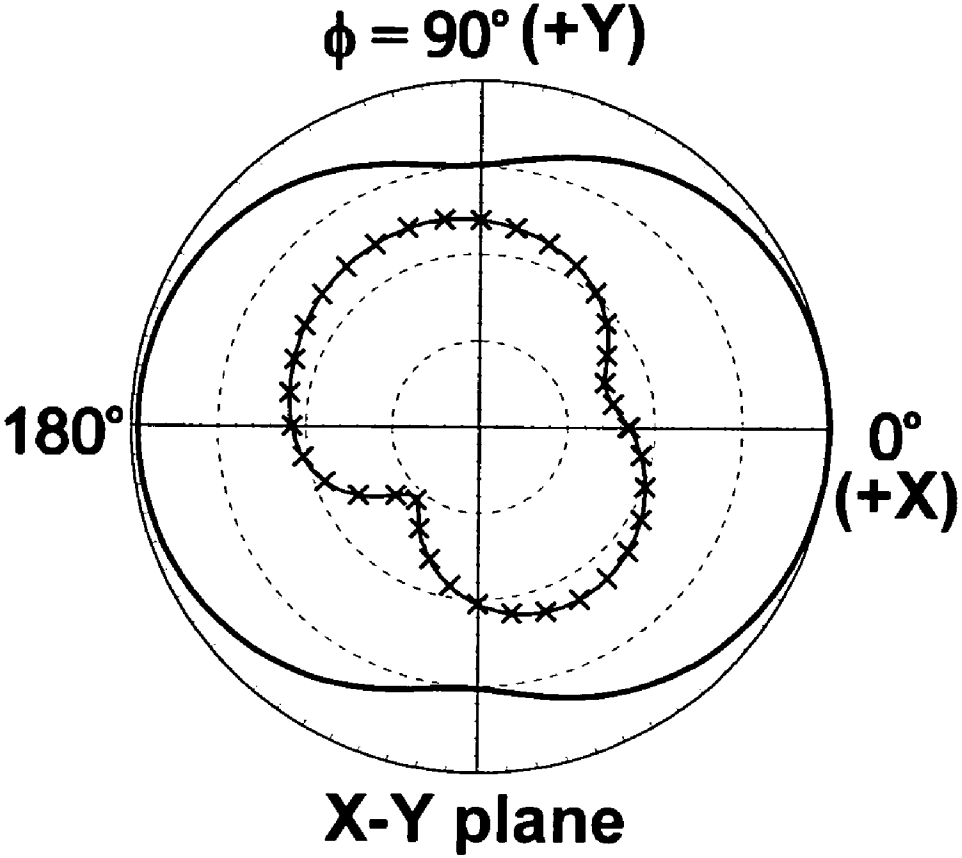
Figure 7C:
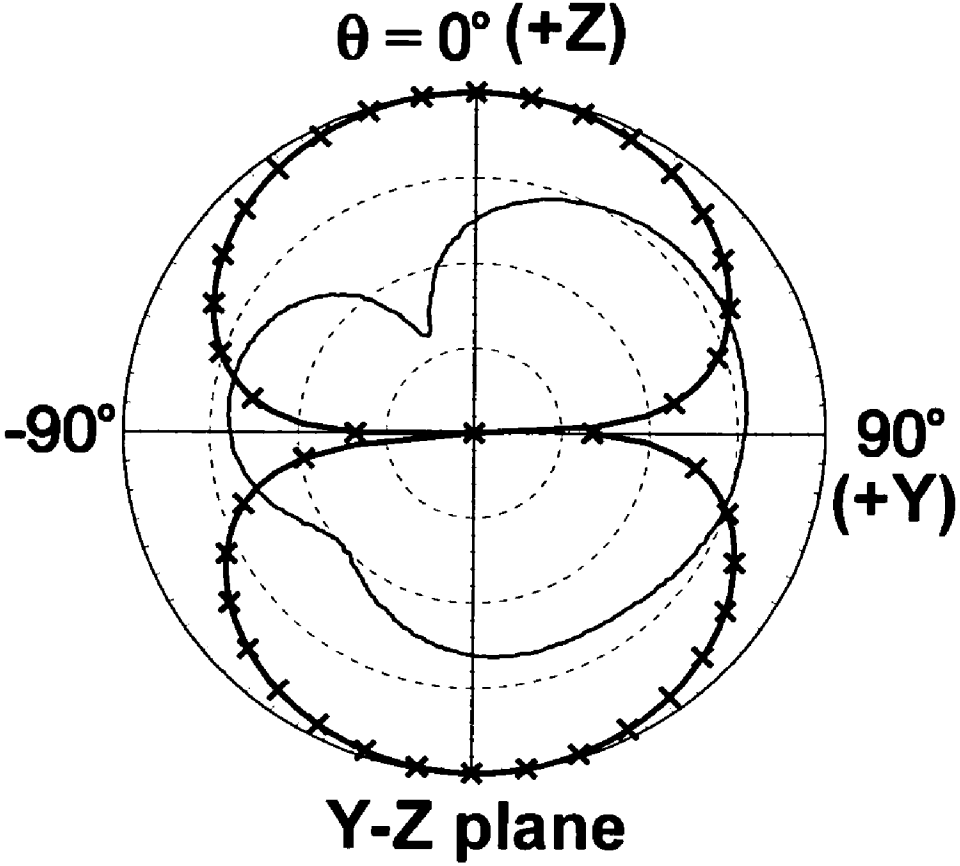

Referring to FIGS. 6, 7A, 7B, and 7C, antenna radiation patterns of the first embodiment when operating at 2.4 GHz are shown. In the figures, X-axis is a reference line. The two radiating arms 120 are symmetrically with respect to the X-axis, and form an included angle of 45 degrees with X-axis (i.e. the included angle between the two radiating arms is 90 degrees). At the same time, the two radiating arms 120 are located in the X-Y plane. Referring to FIG. 7A, the measurement results on the X-Z plane show that a good omnidirectional radiation patterns are obtained. Referring to FIG. 7B, in the X-Y plane, the two radiating arms 120 are facing more in the +X direction, and thus the electromagnetic field is stronger in the +X direction. Referring to FIG. 7C, in the Y-Z plane, the electromagnetic field is mainly null in the +Y and −Y directions.

Figure 8A:
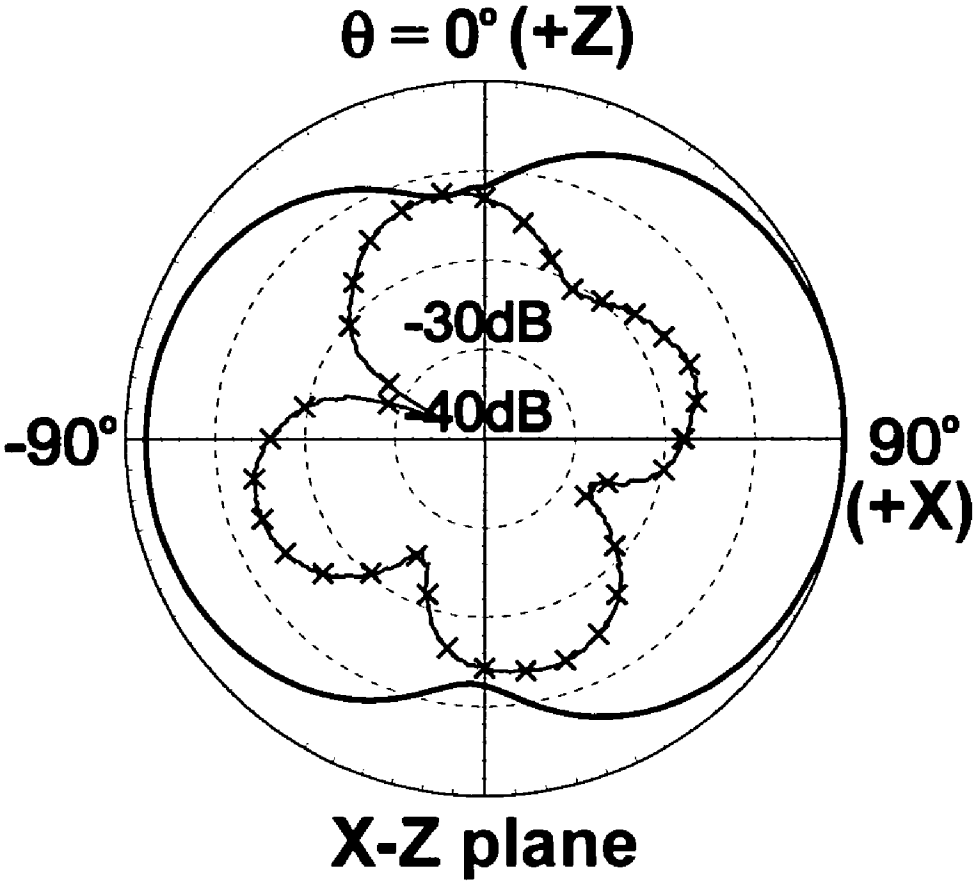
FIGS. 8A, 8B, and 8C show the antenna radiation patterns of the first embodiment at 5.2 GHz at different conference planes.
Figure 8B:
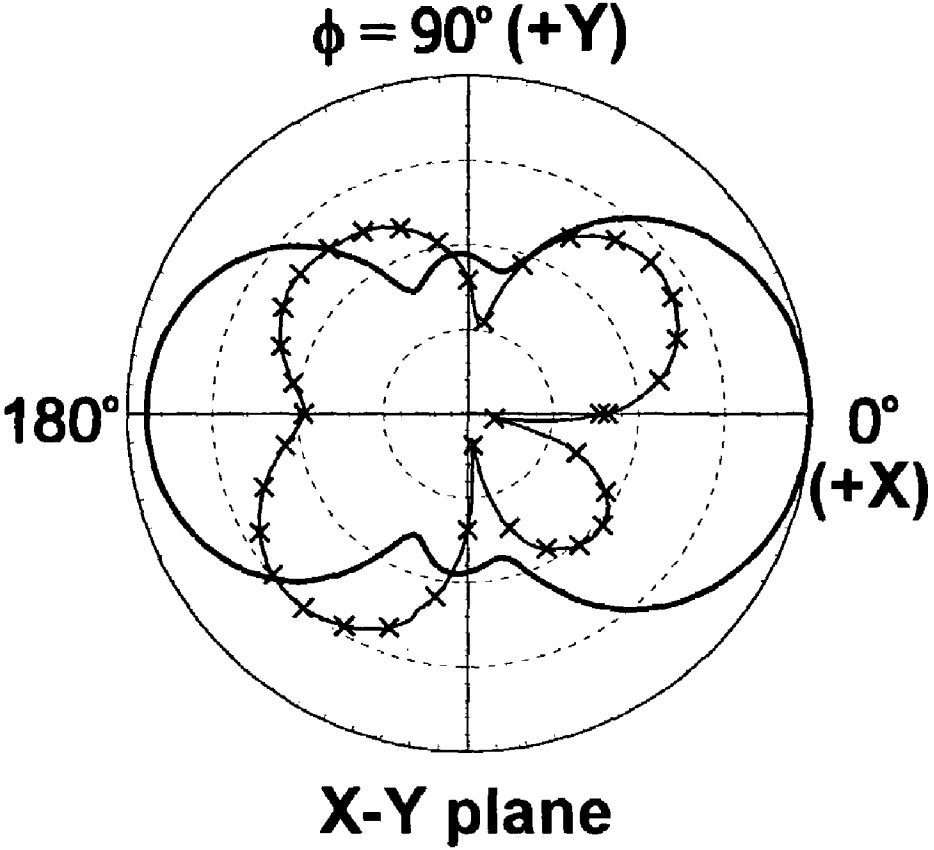
Figure 8C:
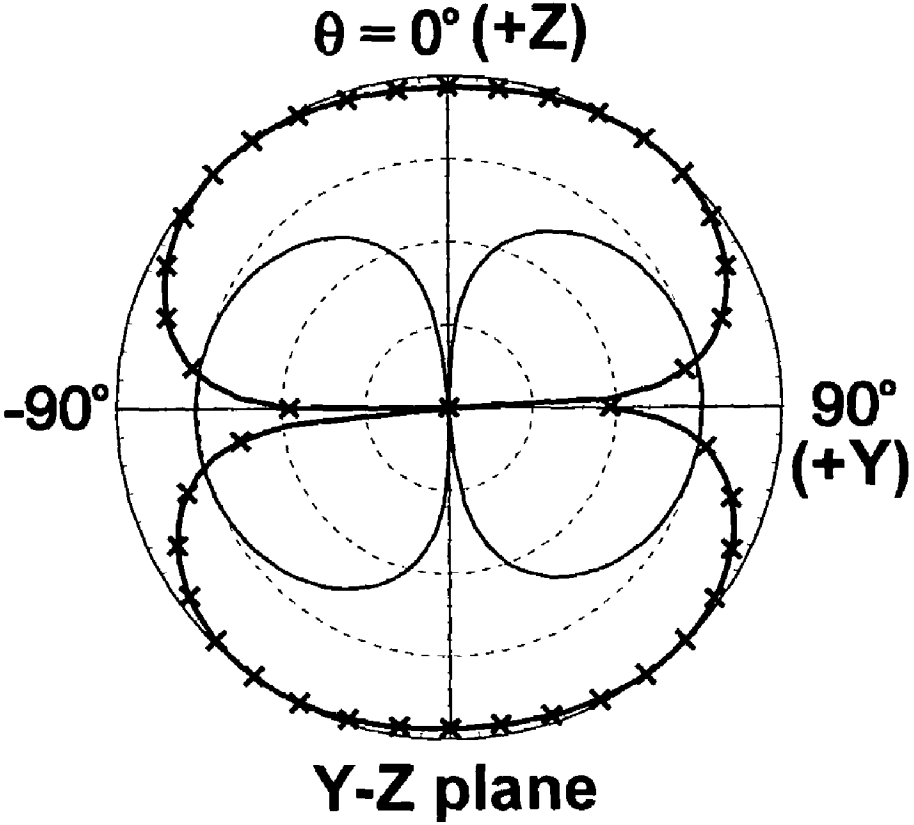

Referring to FIGS. 8A, 8B, and 8C, antenna radiation patterns of the first embodiment when operating at 5.2 GHz are shown. In general, similar radiation patterns to those shown in FIG. 7 are seen. However, the electromagnetic field becomes more directive in the +X and −X directions in the X-Z and X-Y planes.

Figure 9:
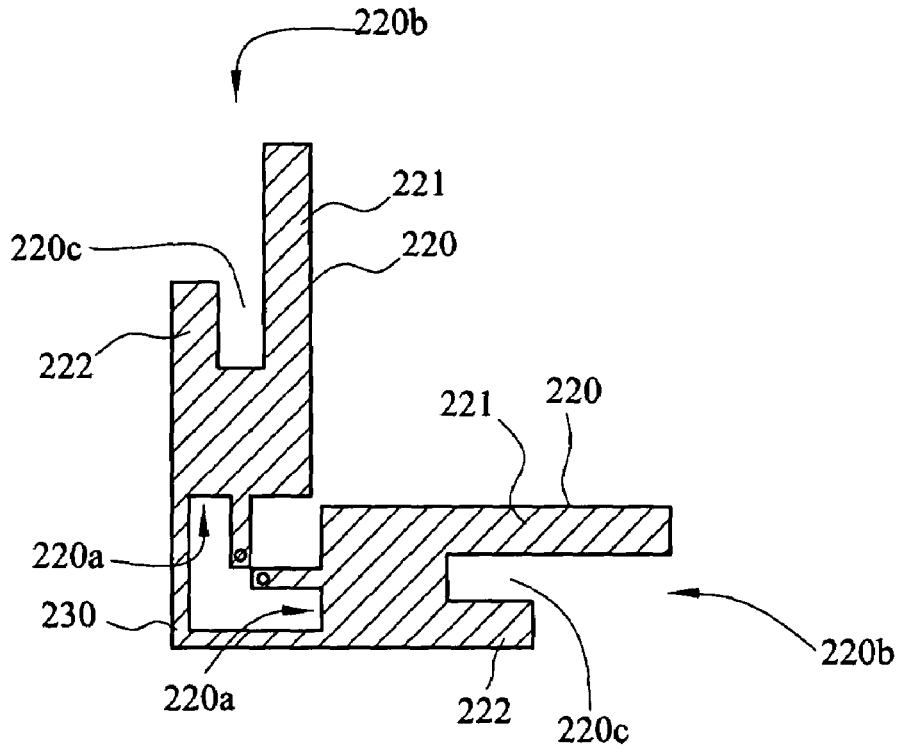
FIG. 9 is a plan view of a second embodiment of the present invention.

Referring to FIG. 9, a dual-band dipole antenna according to a second embodiment of the present invention is shown. The dual-band dipole antenna includes a substrate (not shown), two radiating arms 220, and a short-circuited element 230 connecting the two radiating arms 220. The two radiating arms 220 and the short-circuited element 230 are formed monolithically.

Each radiating arm 220 has a feed-in end 220*a* and a radiating end 220*b*. The radiating end 220*a* includes a first radiating portion 221 and a second radiating portion 222 and extends from the feed-in end 220*a* towards the radiating end 220*b*. The first radiating portion 221 and the second radiating portion 222 are parallel and separated by a slit 220*c*. The length from the end of the first radiating portion 221 to the feed-in end 220*a* is not equal to the length from the end of the second radiating portion 222 to the feed-in end 220*a*. Thus, the resonant frequencies of the first radiating portion 221 and the second radiating portion 222 are different. Therefore, the first radiating portion 221 and the second radiating portion 222 can radiate/receive radio waves of different frequencies respectively. In this embodiment, the first radiating portion 221 radiates/receives a radio wave of 2.4 GHz, and the second radiating portion 222 radiates/receives a radio wave of 5.2 GHz.

The two radiating arms 220 are electrically connected by the short-circuited element 230. The short-circuited element 230 is further electrically connected to a ground line, so the feed-in ends 220*a* of the two radiating arms 220 form a node together. When an electrical signal is fed in or a radio wave signal is sensed, the two radiating arms 220 will generate two resonant frequencies, and the half wavelength of the two resonant frequencies will be equal to the length of the first radiating portion 221 and the second radiating portion 222. Therefore, the two radiating arms 220 may generate the effect of the dipole gain, thus enhancing the capability of radiating/receiving signals.

Figure 10:
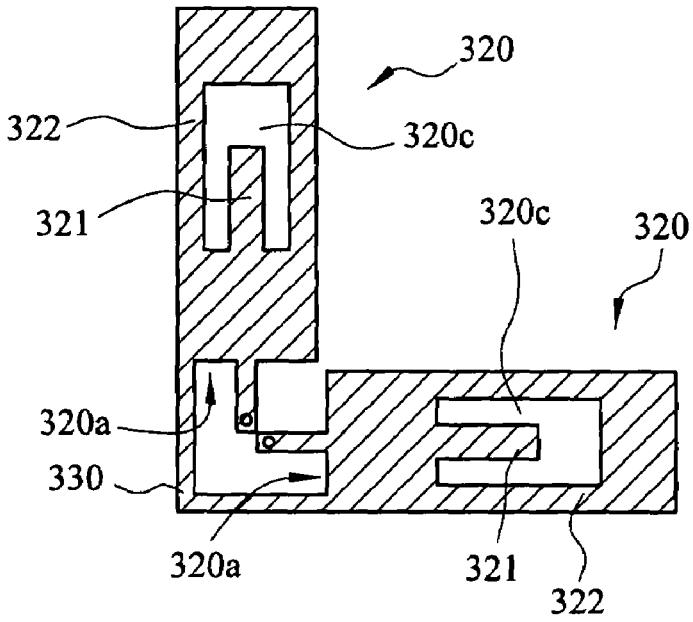
FIG. 10 is a plan view of a third embodiment of the present invention.

Referring to FIG. 10, a dual-band dipole antenna according to a third embodiment of the present invention is shown. The dual-band dipole antenna includes a substrate (not shown), two radiating arms 320, and a short-circuited element 330. Each radiating arm 320 has a curved slot 320*c*, thus forming a suspended first radiating portion 321 and a second radiating portion 322 surrounding the first radiating portion 321 in the radiating arm 320. The length from the end of the first radiating portion 321 to the feed-in end 320*a* is not equal to the length from the end of the second radiating portion 322 to feed-in end 320*a*. Thus, the resonant frequencies of the first radiating portion 321 and the second radiating portion 322 are different. Therefore, the first radiating portion 321 and the second radiating portion 322 can radiate/receive radio waves of different frequencies respectively. In this embodiment, first radiating portion 321 radiates/receives a radio wave of 5.2 GHz, and the second radiating portion 322 radiates/receives a radio wave of 2.4 GHz.

The two radiating arms 320 are electrically connect by the short-circuited element 330. The short-circuited element 330 is further electrically connected to a ground line, so the feed-in ends 320*a* of the two radiating arms 320 form a node together. When an electrical signal is fed in or a radio wave signal is sensed, the two radiating arms 320 will generate two resonant frequencies, and the half wavelength of the two resonant frequencies will be equal to the length of the first radiating portion 321 and the second radiating portion 322 respectively. Therefore, the two radiating arms 320 can generate the effect of the dipole gain, thus enhancing the capability of radiating/receiving signals.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A dual-band dipole antenna, comprising:

two radiating arms, each having a feed-in end and a radiating end, wherein each radiating arm has a slot that divides the radiating end into a first radiating portion and a second radiating portion; and a short-circuited element, monolithically formed with the two radiating arms, and connected to the feed-in end, so as to electrically connect the two radiating arms and make an included angle between the two radiating arms;

wherein the slot is L-shaped.

2. The dual-band dipole antenna as claimed in claim 1, further comprising a substrate, wherein the two radiating arms and the short-circuited element are disposed on the substrate.

3. The dual-band dipole antenna as claimed in claim 2, wherein the material of the substrate is an insulating material.

4. The dual-band dipole antenna as claimed in claim 1, wherein the slot extends from an interior of the radiating arm to the radiating end and makes an opening at an edge of the radiating end.

5. The dual-band dipole antenna as claimed in claim 1, wherein the included angle between the two radiating arms is less than 180 degrees.

6. A dual-band dipole antenna, comprising:

two radiating arms, each having a feed-in end and a radiating end, wherein each radiating arm has a first radiating portion and a second radiating portion respective extending from the feed-in end to the radiating end; and a short-circuited element, monolithically formed with the two radiating arms, and connected to the feed-in end, so as to electrically connect the two radiating arms and make an included angle between the two radiating arms;

wherein the first radiating portion is suspended inside the radiating arm, and the second radiating portion surrounds the first radiating portion.

7. The dual-band dipole antenna as claimed in claim 6, further comprising a substrate, wherein the two radiating arms and the short-circuited element are disposed on the substrate.

8. The dual-band dipole antenna as claimed in claim 7, wherein the material of the substrate is an insulating material.

9. The dual-band dipole antenna as claimed in claim 6, wherein the included angle between the two radiating arms is less than 180 degrees.

10. A dual-band dipole antenna, comprising:

two radiating arms, each having a feed-in end and a radiating end, wherein each radiating arm has a slot that divides the radiating end into a first radiating portion and a second radiating portion; and a short-circuited element, monolithically formed with the two radiating arms, and connected to the feed-in end, so as to electrically connect the two radiating arms and make an included angle between the two radiating arms;

wherein the slot is curved and is disposed inside the radiating arm, such that the first radiating portion is suspended inside the radiating arm, and the second radiating portion surrounds the first radiating portion.

* * * * *